US008919760B2

(12) United States Patent
Kato et al.

(10) Patent No.: US 8,919,760 B2
(45) Date of Patent: Dec. 30, 2014

(54) IMAGE FORMING APPARATUS WITH SETTING UNIT FOR SETTING CURRENT VALUES FOR MOTOR

(71) Applicant: Canon Kabushiki Kaisha, Tokyo (JP)

(72) Inventors: Hirohisa Kato, Toride (JP); Ryuta Mine, Toride (JP); Takeyuki Suda, Toride (JP); Mitsuhiro Sugeta, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/747,248

(22) Filed: Jan. 22, 2013

(65) Prior Publication Data

US 2013/0187329 A1 Jul. 25, 2013

(30) Foreign Application Priority Data

Jan. 24, 2012 (JP) ..... 2012-012310

(51) Int. Cl.

| | |
|---|---|
| ***B65H 3/44*** | (2006.01) |
| ***B65H 5/06*** | (2006.01) |
| ***B65H 7/06*** | (2006.01) |
| ***B65H 3/06*** | (2006.01) |

(52) U.S. Cl.

CPC ..... *B65H 5/06* (2013.01); *B65H 5/062* (2013.01); *B65H 7/06* (2013.01); *B65H 2511/13* (2013.01); *B65H 2515/32* (2013.01); *B65H 3/0669* (2013.01); *B65H 3/44* (2013.01); *B65H 2513/50* (2013.01); *B65H 2555/26* (2013.01)

USPC ..... 271/9.13; 271/10.03; 271/10.11

(58) Field of Classification Search

CPC ..... B65H 3/0669; B65H 3/44; B65H 2301/4454; B65H 2557/264; B65H 2515/32; B65H 2515/704; B65H 2553/51; B65H 2555/26; B65H 2557/64; B65H 2601/521; B65H 2701/1125

USPC ..... 271/9.01, 9.11, 9.12, 9.13, 10.03, 271/10.11, 114, 264; 318/685

See application file for complete search history.

(56) References Cited

U.S. PATENT DOCUMENTS

| | | | | |
|---|---|---|---|---|
| 7,547,016 | B2 * | 6/2009 | Mizuno | 271/264 |
| 2011/0024980 | A1 * | 2/2011 | Sekiya | 271/264 |
| 2011/0229235 | A1 | 9/2011 | Tachibana et al. | |

FOREIGN PATENT DOCUMENTS

| | | | |
|---|---|---|---|
| JP | 2001-322734 A | | 11/2001 |
| JP | 2001322734 A | * | 11/2001 |

* cited by examiner

*Primary Examiner* — Gerald McClain
(74) *Attorney, Agent, or Firm* — Canon USA Inc IP Division

(57) ABSTRACT

An image forming apparatus including an electrophotographic process is disclosed. The image forming apparatus detects a load angle of a motor associated with conveying of an n-th sheet. In accordance with the detected load angle, current values for motors associated with conveying of the n-th sheet, a current value for a motor associated with feeding of sheets following the n-th sheet, and a current value for a motor associated with conveying of the sheets following the n-th sheet are set. Such control is executed when power is turned ON or the like.

8 Claims, 7 Drawing Sheets

FIG. 7

| DETECTED LOAD ANGLE θk | | DETERMINED SHEET | CURRENT SET VALUE [mA] |
|---|---|---|---|
| θa | -30～30° | THIN PAPER | 200 |
| θb | 30～60° | PLAIN PAPER | 400 |
| θc | 60～180° | THICK PAPER | 800 |

FIG. 8

| | DETECTED LOAD ANGLE θk | | |
|---|---|---|---|
| | θa | θb | θc |
| | CURRENT SET VALUE [mA] | | |
| M1 | 200 | 400 | 800 |
| M2 | 200 | 400 | 800 |
| M3 | 200 | 400 | 800 |
| M4 | 200 | 400 | 800 |

IMAGE FORMING APPARATUS WITH SETTING UNIT FOR SETTING CURRENT VALUES FOR MOTOR

BACKGROUND OF THE INVENTION

1. Field of the Invention

The present disclosure relates to a technique of controlling motors for driving rollers to convey a sheet material to be used in an image forming apparatus.

2. Description of the Related Art

A small and inexpensive stepping motor is often used as a drive source for a sheet feeding/conveying system in an image forming apparatus. The stepping motor rotates by a unit step angle in response to a 1-pulse input. This clear relationship between the input and output enables the use of open-loop control to simplify the system including a control mechanism. While the stepping motor can contribute to achieving a compact and inexpensive structure, the stepping motor frequently causes a step-out phenomenon in which the rotation of a rotor cannot be synchronized with the input of a pulse signal. The step-out phenomenon occurs, for example, in an overload state to the pulse rate of the pulse output to the stepping motor from a drive circuit.

An image forming apparatus that performs multifarious types of image formation needs to support various kinds of sheets, such as plain paper and thick paper. Therefore, the required torque of the stepping motor varies significantly depending on the kind of sheets in use. With regard to the torque for causing a sheet to enter between conveying rollers made of a sponge material and disposed along a sheet conveying path, for example, the torque for thick paper (200 g/cm) becomes twice as high as the torque for plain paper (80 g/cm) in some cases. The torque of the stepping motor is determined by the value of the drive current. Therefore, the selection of the stepping motor and the setting of the drive current that determines the torque are determined on the assumption of using thick paper which faces severer conditions.

However, plain paper is frequently used in general offices or the like. Therefore, constant setting of the drive current value for thick paper causes more than necessary power consumption and noise generation. Therefore, a technique to solve this problem is proposed (see U.S. Pat. No. 7,547,016). The apparatus described in U.S. Pat. No. 7,547,016 uses a feedback stepping motor incorporating a sensor which detects the position of the rotor, as an upstream (sheet feeding system) motor. The feedback stepping motor monitors information on the rotational speed and the amount of rotation during rotation by means of the sensor, and performs closed-mode control immediately when a step-out phenomenon is likely to occur. The apparatus described in U.S. Pat. No. 7,547,016 determines the value of the current to a downstream (conveying system) stepping motor based on the result of detection from the sensor.

Recently, there is a proposal of a technique of optimizing the drive current based on the relationship between the maximum output torque of a stepping motor and the level of the drive current (see US 2011/0229235). The technique disclosed in US 2011/0229235 calculates an estimated load torque at the time of conveying a first sheet. The estimated load torque is used to determine a current value corresponding to the size of the target load torque at the time of conveying second and subsequent sheets.

The technique disclosed in U.S. Pat. No. 7,547,016 is effective in preventing a step-out phenomenon. When a plurality of sheet cassettes are mounted for the respective kinds of sheets, however, feedback stepping motors are needed for the respective sheet cassettes. This complicates the control process. Further, the feedback stepping motors are very expensive and undesirably lead to an increase in the cost for the image forming apparatus.

The technique disclosed in US 2011/0229235 independently controls a plurality of stepping motors, thus complicating the control circuit when a plurality of stepping motors are used.

SUMMARY OF THE INVENTION

According to an exemplary embodiment of the present disclosure, there is provided an image forming apparatus for forming an image on a sheet material, the image forming apparatus including: conveying unit having a plurality of conveying paths for conveying the sheet material; a plurality of first motors for driving a plurality of rollers respectively disposed along the plurality of conveying paths; a second motor for driving a roller disposed downstream of a merging point of the plurality of conveying paths; detection unit for detecting a load angle of the second motor; and setting unit for setting, in accordance with the detected load angle of the second motor, current values for driving the first motors and the second motor, the setting unit setting, in accordance with the load angle of the second motor detected by the detection unit at a time of conveying an n-th sheet material, where n is a natural number equal to or larger than 1, the current values for the plurality of first motors and the second motor at a time of conveying sheet materials following the n-th sheet material.

Further features of the present disclosure will become apparent from the following description of exemplary embodiments (with reference to the attached drawings).

BRIEF DESCRIPTION OF THE DRAWINGS

FIG. 7 is a diagram illustrating the relationship between the load angle, a result of sheet determination, and a current set value.

FIG. 8 is a diagram illustrating the relationship between the load angle and a current set value of a conveying stepping motor.

DESCRIPTION OF THE EMBODIMENTS

An exemplary embodiment of the present disclosure is described hereinafter. An image forming apparatus including an electrophotographic process is described herein by way of example. Specifically, a case is taken as an example in which a sheet material is a printing sheet, and two sheet cassettes are mounted as an example. In the example, a plurality of constant current controlled motors are all stepping motors.

Figure 1:
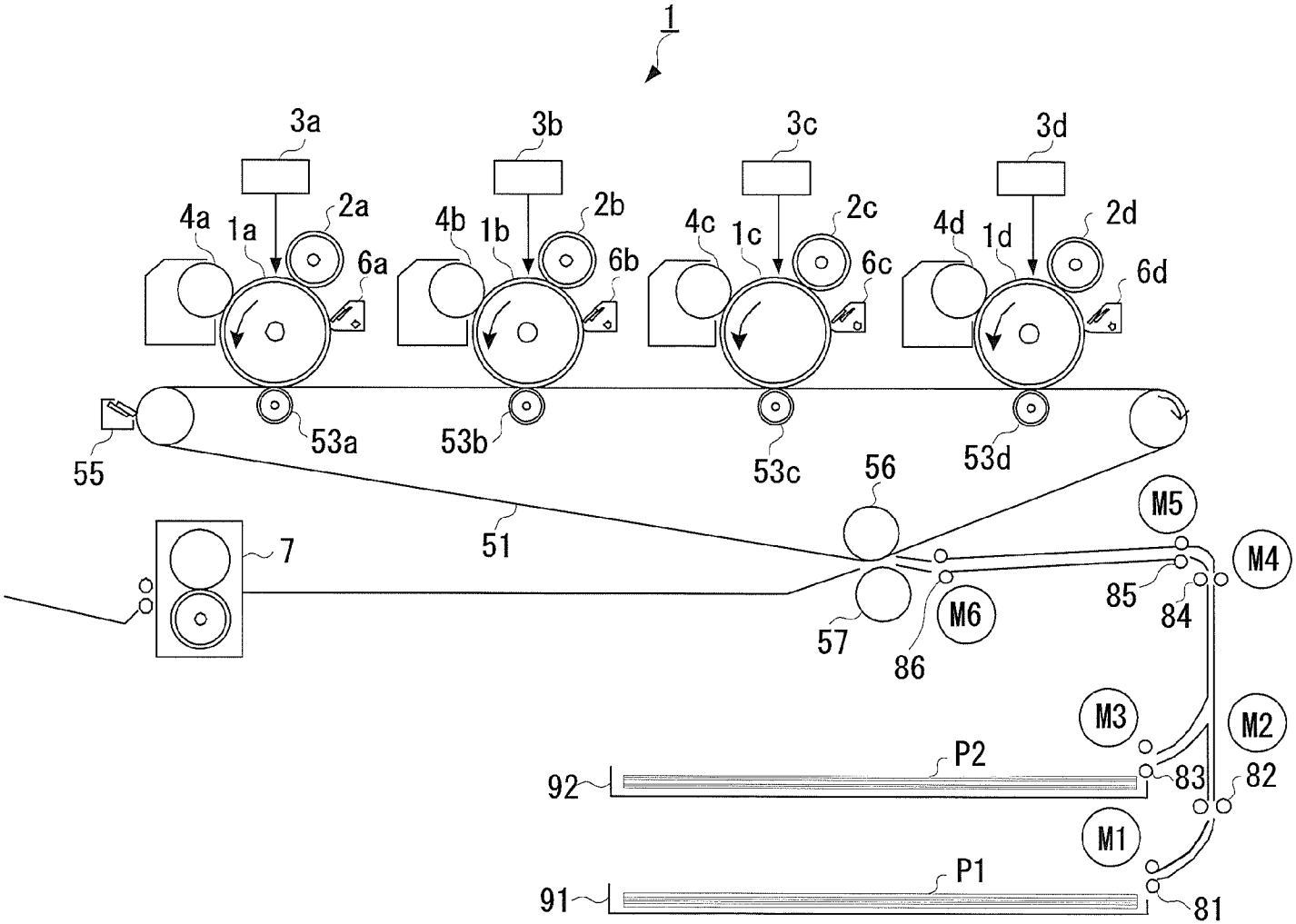
FIG. 1 is a schematic cross-sectional view of an image forming apparatus according to an exemplary embodiment.

FIG. 1 is a schematic cross-sectional view of an image forming apparatus 1 according to this exemplary embodiment.

The image forming apparatus 1 according to this exemplary embodiment includes photosensitive members (photosensitive drums) 1*a* to 1*d* of four colors (Y, M, C, and K), respectively, which each rotate in the arrow direction of FIG. 1. Upon reception of an image signal and a print instruction from the outside, the image forming apparatus 1 uniformly charges the photosensitive members 1*a* to 1*d* with primary charge units 2*a* to 2*d*, respectively. The image forming apparatus 1 also causes exposure units 3*a* to 3*d* to perform exposure in accordance with the image signal to form electrostatic latent images on the photosensitive members 1*a* to 1*d*, respectively. The electrostatic latent images are developed by developing units 4*a* to 4*d* to form toner images, respectively.

The image forming apparatus 1 according to this exemplary embodiment has sheet cassettes 91 and 92 mounted therein to enable arbitrary changing of the kind of sheet, such as plain paper and thick paper or a sheet of A4 size and a sheet of A3 size, from one to another. The kind of sheet to be used may be specified so that any one of the sheet cassettes 91 and 92 which retains the sheet corresponding to the specification result may be specifically selected.

When the sheet cassette 91 is selected, a sheet P1 is supplied to sheet feed rollers 81 at a proper timing in the image forming process. The sheet P1 is further supplied to secondary transfer units 56 and 57 via conveying rollers 82, 84, 85, and 86. The sheet feed rollers 81 and the conveying rollers 82, 84, 85, and 86 are driven by stepping motors M1, M2, M4, M5, and M6, respectively. The toner images of the respective colors developed on the photosensitive members 1*a* to 1*d* are multi-transferred on an intermediate transfer belt 51 in primary transfer units 53*a* to 53*d*, respectively. The transferred images are further transferred on the sheet P1 in the secondary transfer units 56 and 57.

Further, when the sheet cassette 92 is selected, a sheet P2 is supplied to sheet feed rollers 83 at a proper timing in the image forming process. The sheet P2 is further supplied to the secondary transfer units 56 and 57 via the conveying rollers 84, 85, and 86.

The sheet feed rollers 83 and the conveying rollers 84, 85, and 86 are driven by stepping motors M3, M4, M5, and M6, respectively. The toner images of the respective colors developed on the photosensitive members 1*a* to 1*d* are multi-transferred on the intermediate transfer belt 51 in the primary transfer units 53*a* to 53*d*, respectively. The transferred images are further transferred on the sheet P2 in the secondary transfer units 56 and 57.

The sheet P1 or P2 supplied from the sheet cassette 91 or 92 is conveyed by the common conveying rollers 84, 85, and 86 which are respectively driven by the stepping motors M4, M5, and M6.

In this manner, the image forming apparatus 1 includes a plurality of conveying paths respectively corresponding to a plurality of sheet cassettes to convey sheet materials fed from the plurality of sheet cassettes 91 and 92. The stepping motor M3 drives the sheet feed rollers 83 disposed in the conveying path corresponding to the sheet material fed from the sheet cassette 92. The stepping motors M1 and M2 respectively drive the sheet feed rollers 81 and the conveying rollers 82 disposed in the conveying path corresponding to the sheet material fed from the sheet cassette 91. The stepping motors M4, M5, and M6 respectively drive the conveying rollers 84, 85, and 86 disposed in the conveying path located downstream of the merging point of the plurality of conveying paths.

The toner remaining on the photosensitive members 1*a* to 1*d* after the transfer is collected by cleaners 6*a* to 6*d*, respectively. The post-transfer remaining toner on the intermediate transfer belt 51 is collected by an intermediate transfer belt cleaner 55. The toner image transferred on the sheet P is fixed by a fixing unit 7 to provide a color image.

Figure 2:
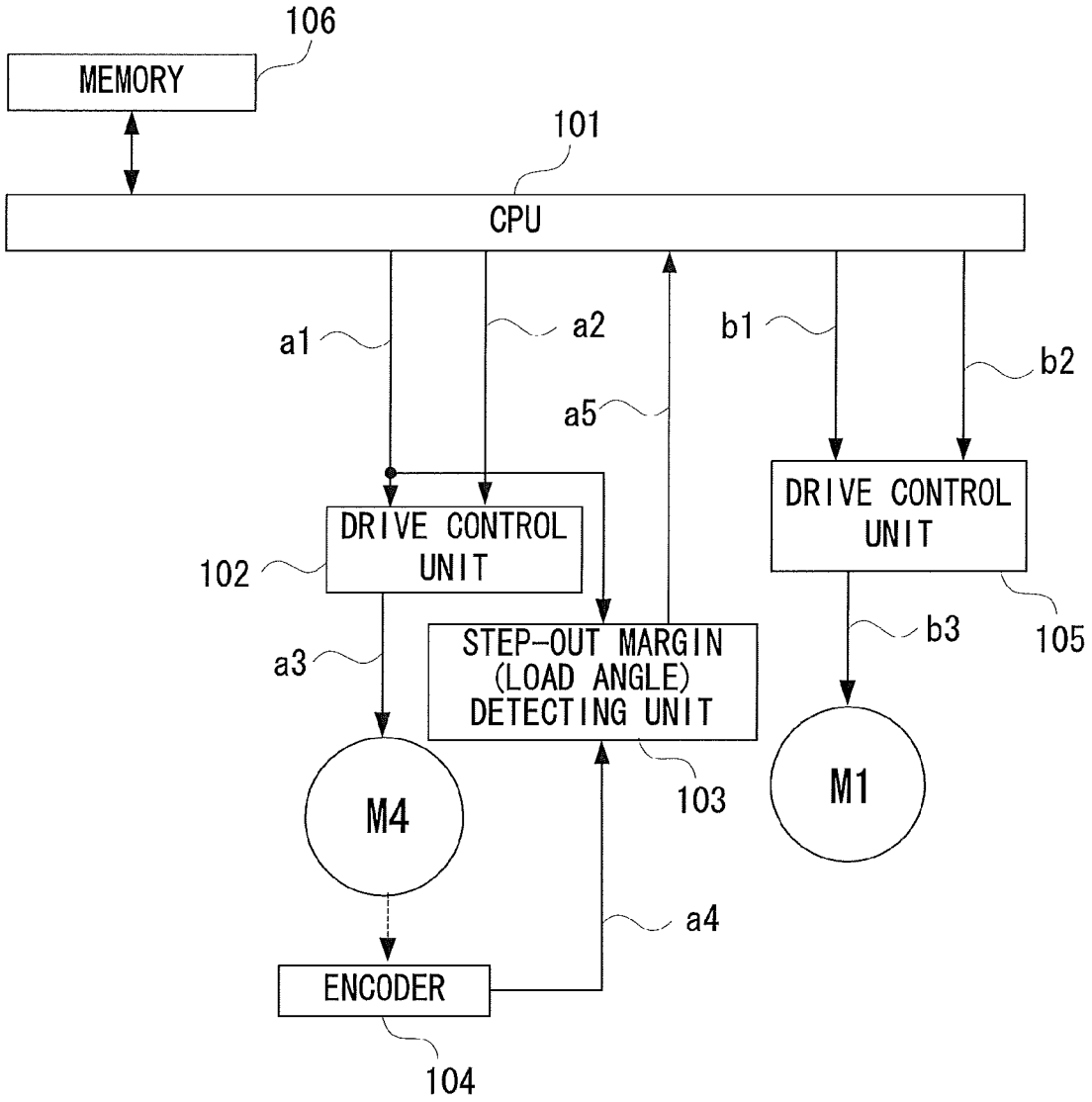
FIG. 2 is an explanatory diagram of a control system for a sheet feeding system and a conveying system according to the exemplary embodiment.

FIG. 2 is a diagram illustrating a drive control system for a sheet feeding process and a conveying process of the image forming apparatus 1. A central processing unit (CPU) 101 performs the general control of the image forming apparatus 1. The CPU 101 loads and runs a control program for image formation to control the general operation of the image forming apparatus 1. The CPU 101 is connected to drive control units 102 and 105 and a memory 106.

Of the conveying rollers commonly used to convey the sheet P1 or P2 supplied from the sheet cassette 91 or 92, the conveying rollers 84 are located most upstream. The conveying rollers 84 are driven by the conveying stepping motor M4 under control of the drive control unit 102. The other conveying rollers are respectively driven by the conveying stepping motors M2, M5, and M6 under control of the drive control unit 105. The conveying rollers 81 and 83 each serving to feed a sheet are respectively driven by the sheet-feeding stepping motors M1 and M3 under control of the drive control unit 105. The sheet-feeding stepping motors M1 and M3 are the most upstream stepping motors. In case of supplying the sheet P1 from the sheet cassette 91, for example, the conveying stepping motor M6 may be driven at a timing slightly delayed from that of the sheet-feeding stepping motor M1 because the conveying stepping motor M6 need not be driven at the time of feeding a sheet.

Description is given below of a case where the sheet P1 is supplied from the sheet cassette 91. Because the sheet-feeding stepping motor M1 is identical to the conveying stepping motors M2, M5, and M6 in configuration and operation, the description thereof is omitted.

The drive control unit 102 supplies a drive current a3 to the conveying stepping motor M4 based on a position instruction signal a1 and a current set value a2 from the CPU 101. An encoder 104 is mounted on the conveying stepping motor M4. The encoder 104 outputs a rotation signal a4 for the conveying stepping motor M4 to a step-out margin (load angle) detecting unit 103. The step-out margin (load angle) detecting unit 103 calculates the load angle of the conveying stepping motor M4 based on the position instruction signal a1 from the CPU 101 and the rotation signal a4 from the encoder 104, and outputs information a5 on the load angle to the CPU 101.

Based on a position instruction signal b1 and a current set value b2 from the CPU 101, the drive control unit 105 supplies a drive current b3 to each of the sheet-feeding stepping motor M1 and the conveying stepping motors M2, M5, and M6.

The memory 106 stores the respective current set values for the conveying stepping motor M4 and the sheet-feeding stepping motor M1, the information a5 on the load angle detected by the conveying stepping motor M4, and various results of calculation performed by the CPU 101.

The driving of the conveying stepping motor M4 and the sheet-feeding stepping motor M1 is controlled as follows. The CPU 101 determines the current set values a2 and b2 respectively representing the values of the drive currents for the conveying stepping motor M4 and the sheet-feeding stepping motor M1 based on the information a5 on the load angle from the step-out margin (load angle) detecting unit 103. That is, the CPU 101 serves as current set value determination means. In accordance with the current set value a2, the drive control unit 102 executes constant current control in such a way that the current flowing to the conveying stepping motor M4 is constant. Specifically, the drive control unit 102 performs chopping control to supply a constant current to the conveying stepping motor M4.

Likewise, in accordance with the current set value b2, the drive control unit 105 executes constant current control in such a way that the current flowing to the sheet-feeding stepping motor M1 is constant. That is, the drive control unit 105 performs chopping control to supply a constant current to the sheet-feeding stepping motor M1.

Figure 3:
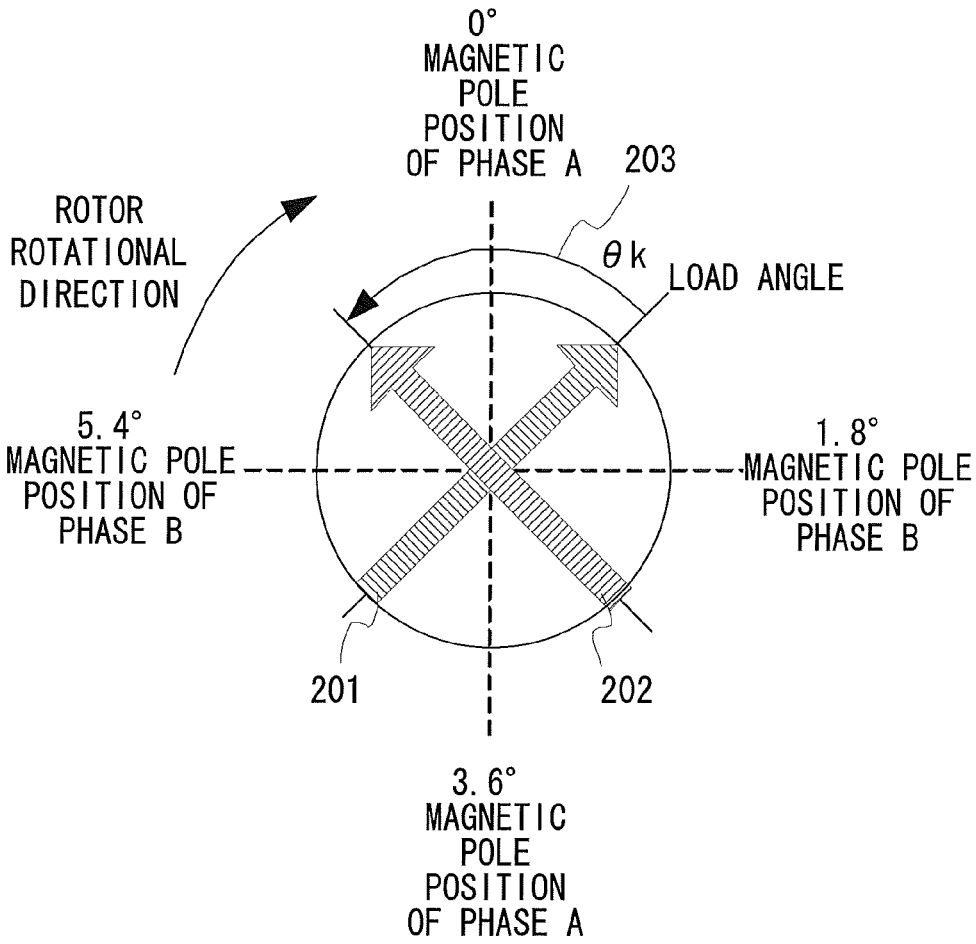
FIG. 3 is an explanatory diagram of a load angle.

Next, the load angle of the stepping motor is described referring to FIG. 3.

FIG. 3 is a status explanatory diagram exemplifying a case where the stepping motor having a step angle of 1.8 degrees is driven by two-phase excitation involving a phase A and a phase B. In FIG. 3, the abscissa represents the magnetic pole position of the phase B, and the ordinate represents the magnetic pole position of the phase A. Because one step is 1.8 degrees in terms of a physical angle, a physical angle of 7.2 degrees is equivalent to an electrical angle of 360 degrees in case of two-phase excitation.

In the example of FIG. 3, the rotation of a rotor is controlled in a clockwise direction about the center. It is assumed that the rotation signal a4 from the encoder 104 represents that the rotor of the conveying stepping motor M4 is in a detection position 202. It is assumed that, based on the position instruction signal a1, the drive control unit 102 controls and drives the rotor of the conveying stepping motor M4 to rotate toward a target position 201. A delay angle θk of the detection position 202 with respect to the target position 201 is the load angle.

Figure 4:
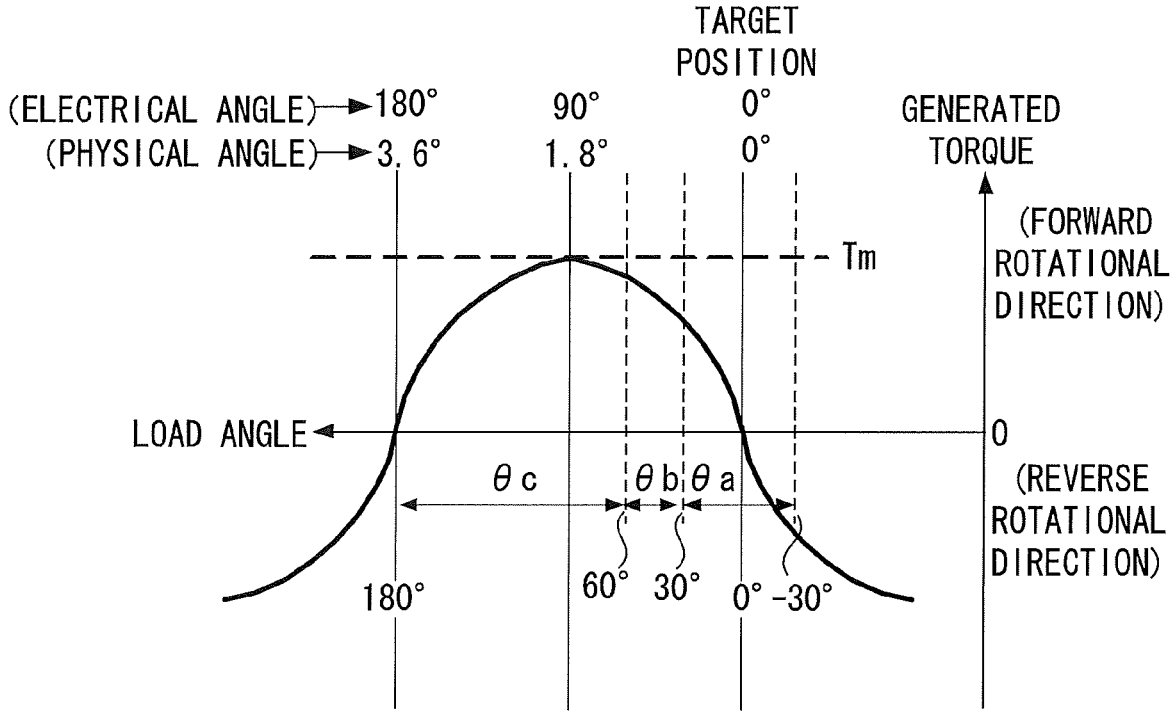
FIG. 4 is an explanatory diagram of the relationship between the load angle and torque generated in a motor.

The relationship between the load angle and the torque generated by the motor is described referring to FIG. 4. FIG. 4 exemplifies a case where the stepping motor with a step angle of 1.8 degrees is driven with two-phase excitation at a certain set current. The ordinate represents the torque generated by the motor, and the abscissa represents the load angle. The center left direction in FIG. 4 indicates the rotor delay direction in response to the rotor position instruction which is output when the rotor is controlled and driven to rotate to the target position 201.

In FIG. 4, when the load angle is 0 degrees, that is, the amount of the delay of the rotor in response to the rotor position instruction is zero, the torque generated in the stepping motor is zero as well. As the load angle increases from this point, the torque in the rotational angle of the rotor increases. At the load angle of 90 degrees, the stepping motor generates a maximum torque Tm. When the load angle further increases and exceeds 90 degrees, the torque in the forward rotational direction decreases until the load angle becomes 180 degrees, and steps out at the load angle of 180 degrees.

That is, when the stepping motor is driven at a certain set current, the maximum torque Tm which can be generated by the motor is determined by the set current. The relationship between the load angle and the generated torque is also determined accordingly. It is therefore possible to know the level of the torque generated in the stepping motor from information on the load angle when the stepping motor is driven. It is also possible to know the state of the motor load.

With this principle applied to the stepping motor M4 that conveys the sheet P1, it is possible to know information on the sheet P1 supplied, for example, information on the thickness of the sheet, such as thin paper, plain paper, or thick paper. In the region of a load angle θa (electrical angle of −30 degrees to +30 degrees), for example, the torque is small, and hence the sheet is thin paper. In the region of a load angle θb (electrical angle of +30 degrees to +60 degrees), the torque increases stably but is not the maximum, and hence the sheet is plain paper. In the region of a load angle θc (electrical angle of +60 degrees to +180 degrees), the motor generates the maximum torque Tm, and hence the sheet is thick paper.

Figure 5:
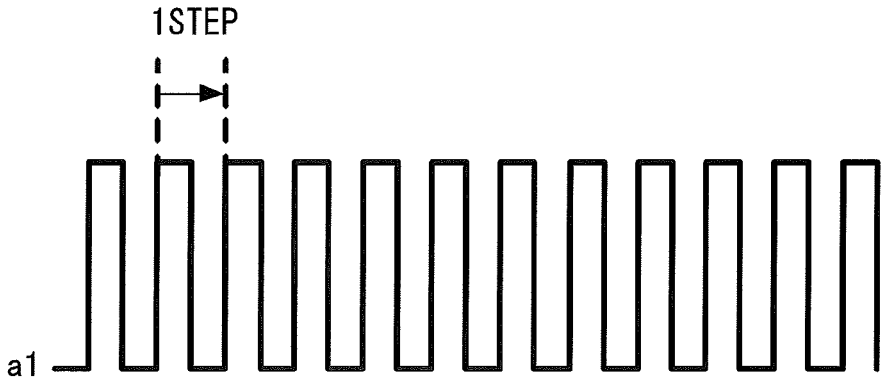
FIG. 5 is an explanatory diagram of the timing of detecting the load angle.

FIG. 5 is an explanatory diagram illustrating the timing for detecting the load angle. A single pulse of the position instruction signal a1 serves to advance the rotor by 1 step. In FIG. 5, the timing of the rise of the position instruction signal a1 is the timing at which the target position 201 of the rotor is changed, and at which the load angle is to be detected.

Next, procedures of a current setting process for driving the conveying stepping motor M4 and the sheet-feeding stepping motor M1 are described.

The current setting process is started when the sheet kind is changed, i.e., selection of the sheet cassette is changed, when power supply to the image forming apparatus 1 is cut off, and when power supply to the CPU 101 is cut off due to, for example, an energy save mode in a standby mode. This is because it is probable in those cases that the sheet kind is changed, that is, selection of the sheet cassette is changed. According to this exemplary embodiment, the current setting process is executed when any one of the sheet cassettes 91 and 92 is selected, and when power supply is started.

This exemplary embodiment does not adopt a configuration where a circuit for executing the current setting process is provided for each of a plurality of conveying paths. The circuit for executing the current setting process is provided for the conveying stepping motor M4 for driving the conveying rollers disposed in the conveying path downstream of the merging point of the plurality of conveying paths.

Figure 6:
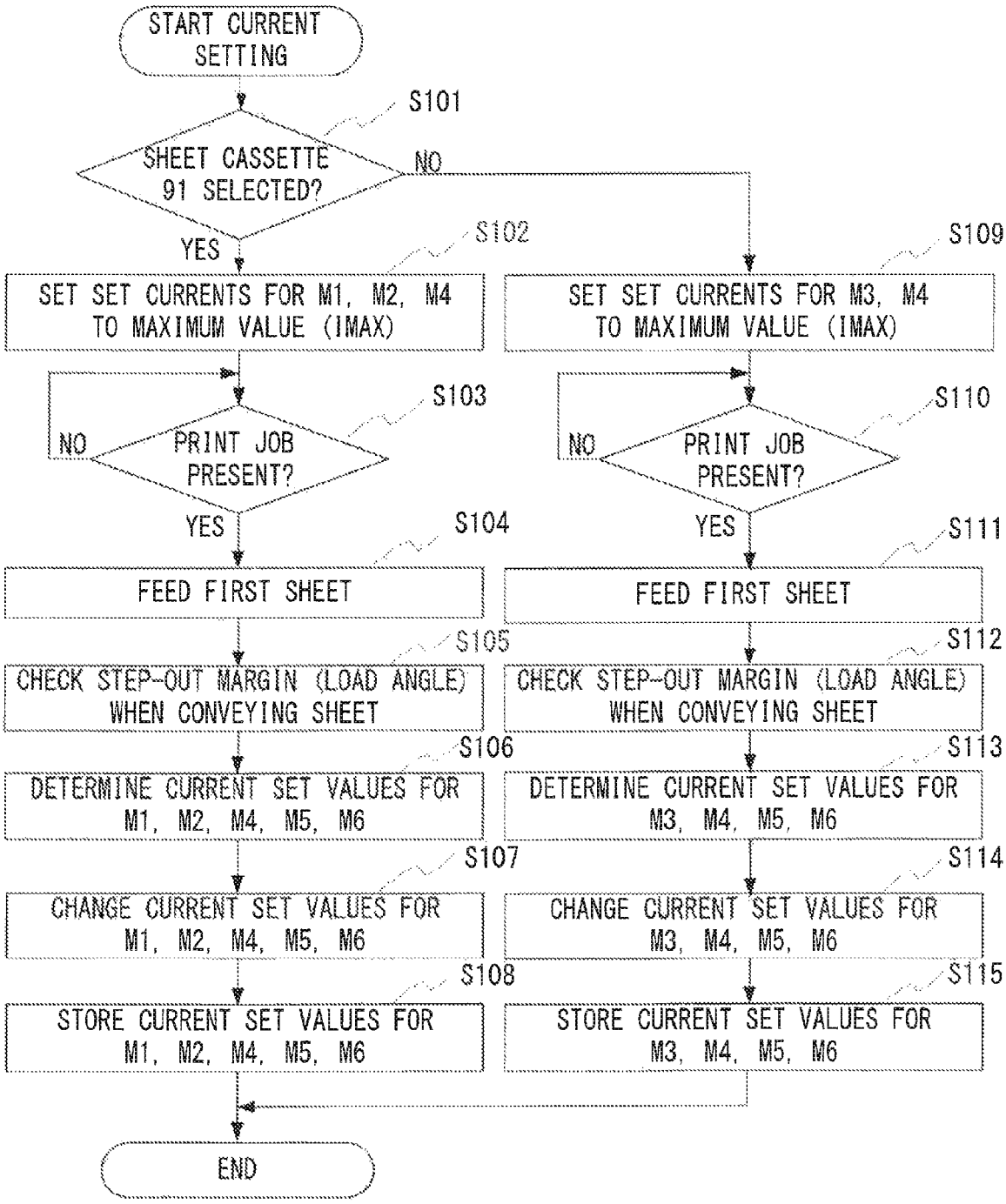
FIG. 6 is a procedure explanatory diagram illustrating procedures of a current process for setting stepping motors.

Then, the sheet kind is confirmed by the load angle of the conveying stepping motor M4, and the current set values of various stepping motors including the stepping motor M1 corresponding to the confirmed sheet kind are determined. An example of the procedures of the current setting process is illustrated in FIG. 6.

The current setting process is started upon power ON and upon detection of a change in selection of the sheet cassette. Power ON means start of power supply to the image forming apparatus 1 or supply of power to the CPU 101 as a result of returning from the standby mode.

First, it is determined whether or not the sheet cassette 91 is selected (S101).

With the sheet cassette 91 selected (S101: YES), the drive currents for the sheet-feeding stepping motor M1 and the conveying stepping motors M2 and M4 for a print job are each set to a predetermined current value for generating a predetermined torque.

The predetermined torque is the torque needed to feed and convey a sheet with a maximum thickness among feedable and conveyable sheets. In this case, for the sake of convenience, the predetermined torque is set to the maximum value among drive currents that can drive the sheet-feeding stepping motor M1, and the conveying stepping motors M2 and M4 (S102). This set value is called "maximum current set value (Imax)". Because the sheet-feeding stepping motor M1 and the conveying stepping motor M2 are disposed upstream of the conveying stepping motor M4 in the conveying path, a predetermined current value is set in Step S102.

Although the maximum value of the drivable current is set as a predetermined torque according to this exemplary embodiment, the value is not limited to the maximum value, and may be any current value which provides a torque necessary to feed and convey a sheet with the maximum thickness among feedable and conveyable sheets P.

Next, it is determined whether or not there is a print job (S103). When there is no print job (S103: NO), the mode proceeds to a standby mode.

When there is a print job (S103: YES), the sheet-feeding stepping motor M1 is driven using the maximum current set value (Imax) set in S102 to start feeding the topmost sheet in the sheet cassette 91 to the sheet feed rollers 81 (S104). Further, the conveying stepping motors M2 and M4 are driven using the maximum current set value (Imax) set in S102 to convey the fed topmost sheet to the conveying rollers 82 and 84 (S104). Then, at the time when the conveying rollers 84 convey the first sheet, the load angle of the conveying stepping motor M4 is detected (S105).

Then, the current set values for the conveying stepping motors M5 and M6 disposed downstream of the conveying stepping motor M4, and the current set values for the sheet-feeding stepping motor M1 and the conveying stepping motors M2 and M4 for feeding and conveying second and subsequent sheets are determined based on the detected load angle (S106). The relationship between the load angle θk and the current set value is shown in, for example, FIG. 7.

Suppose that the load angle θk detected when the sheet P is conveyed by the conveying stepping motor M4 driven at the maximum current set value (Imax) is, for example, θa (−30 degrees to +30 degrees) shown in FIG. 4. In this case, it is determined that the fed sheet P is thin paper, and the current set value for feeding a next sheet is set to 200 (mA). Accordingly, the sheets P can be fed at a minimum cost from the next sheet feeding. When the load angle θk is θb (+30 degrees to +60 degrees), it is determined that the fed sheet P is plain paper, and the current set value for feeding a next sheet is set to 400 (mA). When the load angle θk is θc (+60 degrees to +180 degrees), it is determined that the fed sheet P is thick paper, and the current set value for feeding a next sheet is set to 800 (mA).

FIG. 8 shows examples of the load angle θk detected by the conveying stepping motor M4, and the current set values for the sheet-feeding stepping motors M1 and M3 and the conveying stepping motor M2.

FIG. 8 shows the examples of the current set values on the premise that the conveying stepping motor M4 and the individual conveying stepping motors have the same specifications, and independently operate at different timings.

Note that, the current set values are not always set on the above-mentioned premise. For example, there may be a case where the sheet feed rollers 81 and the conveying rollers 82 can be operated in the same sequence in FIG. 1. In this case, the conveying stepping motor M2 can be eliminated. That is, the sheet-feeding stepping motor M1 drives both of the sheet-feeding rollers 81 and the conveying rollers 82. As a result, the sheet-feeding stepping motor M1 needs to be able to output a greater torque than those of the sheet-feeding stepping motor M3 and the conveying stepping motor M4. Accordingly, a different motor is disposed only for the sheet-feeding stepping motor M1. In such a case, a unique current set value for ensuring feeding of the sheet P only needs to be set for the sheet-feeding stepping motor M1.

Returning to FIG. 6, the previous current set values for the stepping motors M1, M2, M4, M5, and M6 are changed to the current set values respectively determined therefor in the above-mentioned manner (S107). The changed current set values are stored in the memory 106 (S108). Then, the current setting process is ended.

When the sheet cassette 92 is selected (S101: NO), the drive currents for the sheet-feeding stepping motor M3 and the conveying stepping motor M4 for a print job are each set to a predetermined current value for generating a predetermined torque (S109). Because the sheet-feeding stepping motor M3 is disposed upstream of the conveying stepping motor M4 in the conveying path, a predetermined current value is set in Step S109.

Although the maximum value of the drivable current is set as a predetermined current value according to this exemplary embodiment, the value does not need to be set to the maximum value, and may be any current value which provides a torque necessary to feed and convey a sheet with the maximum thickness among feedable and conveyable sheets P.

Next, it is determined whether or not there is a print job (S110). When there is no print job (S110: NO), the mode proceeds to a standby mode.

When there is a print job (S110: YES), the sheet-feeding stepping motor M3 is driven using the maximum current set value (Imax) set in S109 to start feeding the topmost sheet in the sheet cassette 92 to the sheet feed rollers 83 (S111). Further, the conveying stepping motor M4 is driven using the maximum current set value (Imax) set in S109 to start conveying the fed topmost sheet to the conveying rollers 84 (S111). Then, at the time when the conveying rollers 84 convey the first sheet, the load angle of the conveying stepping motor M4 is detected (S112).

Then, the current set values for the conveying stepping motors M5 and M6 disposed downstream of the conveying stepping motor M4, and the current set values for the sheet-feeding stepping motor M3 and the conveying stepping motor M4 for feeding and conveying second and subsequent sheets are determined based on the detected load angle (S113). The previous current set values for the stepping motors M3, M4, M5, and M6 are changed to the current set values respectively determined therefore in the above-mentioned manner (S114). The changed current set values are stored in the memory 106 (S115). Then, the current setting process is ended.

When there is plurality of print jobs in Step S103 or S110, subsequent printing is executed based on the current set values stored in Step S108 or S115. Then, in accordance with the sheet cassette selected after the end of the current setting process, the corresponding sheet-feeding stepping motor is specified. Then, the load angle stored in the memory 106 is read out, and the current set values for the respective stepping motors can be set or changed based on the load angle.

According to this exemplary embodiment, as described above, the optimal current value for feeding and conveying a sheet, regardless of from which sheet cassette the sheet is supplied, can be set based on the load angle θk detected by the conveying stepping motor M4. In other words, current consumption can be suppressed within the range where a step-out phenomenon does not occur.

Further, the drive current at the current set value for the conveying stepping motor M4 drives the remaining motors in the path where the sheet is conveyed, and hence the control system at the time of operating a plurality of motors in cooperation with one another is simplified. According to this exemplary embodiment, the load angle of the stepping motor disposed in the conveying path downstream of the merging point of the plurality of conveying paths is detected, thus eliminating the need for detecting the load angles of the stepping motors disposed in the respective conveying paths. This can reduce the number of components for detecting the load angle. That is, the structure for detecting the load angle is not necessary for each sheet cassette (sheet feeding system), thus contributing to cost reduction of the image forming apparatus 1.

The conveying stepping motors M5 and M6 are driven at timing delayed from the timing of the conveying stepping motor M4. Accordingly, immediate driving of the conveying stepping motors M5 and M6 at the changed current set value can permit the first sheet to be conveyed by the drive current at the changed current set value. That is, sheet feeding and conveyance can be carried out with less power consumption.

Further, the stepping motor that detects the load angle θk may be the conveying stepping motor M5 or M6. This modification increases the degree of freedom of the configuration to be adopted for the image forming apparatus 1.

According to this exemplary embodiment, the current values for the conveying stepping motors M5 and M6 at the time of conveying the first sheet, and the current values for the sheet-feeding stepping motor M1 and the like at the time of feeding the second and subsequent sheets are set, for example, in accordance with the load angle of the conveying stepping motor M4 at the time of conveying the first sheet. However, the setting may be carried out in accordance with the load angle of the conveying stepping motor M4 at the time of conveying an m-th sheet (m>1) instead of the first sheet. In this case, the conveying stepping motor M4 is driven at a predetermined current value until the m-th sheet, and the conveying stepping motors M5 and M6 are driven at the predetermined current value until an (m−1)th sheet. Then, the current values for the sheet-feeding stepping motors M1 and M2 and the conveying stepping motor M4 for (m+1)th and subsequent sheets are set in accordance with the statistical value (e.g., average value) of the load angles of the conveying stepping motor M4 until the m-th sheet. The current values for the conveying stepping motors M5 and M6 for the m-th and subsequent sheets are set in accordance with the statistical value.

First Modification

Figure 9:
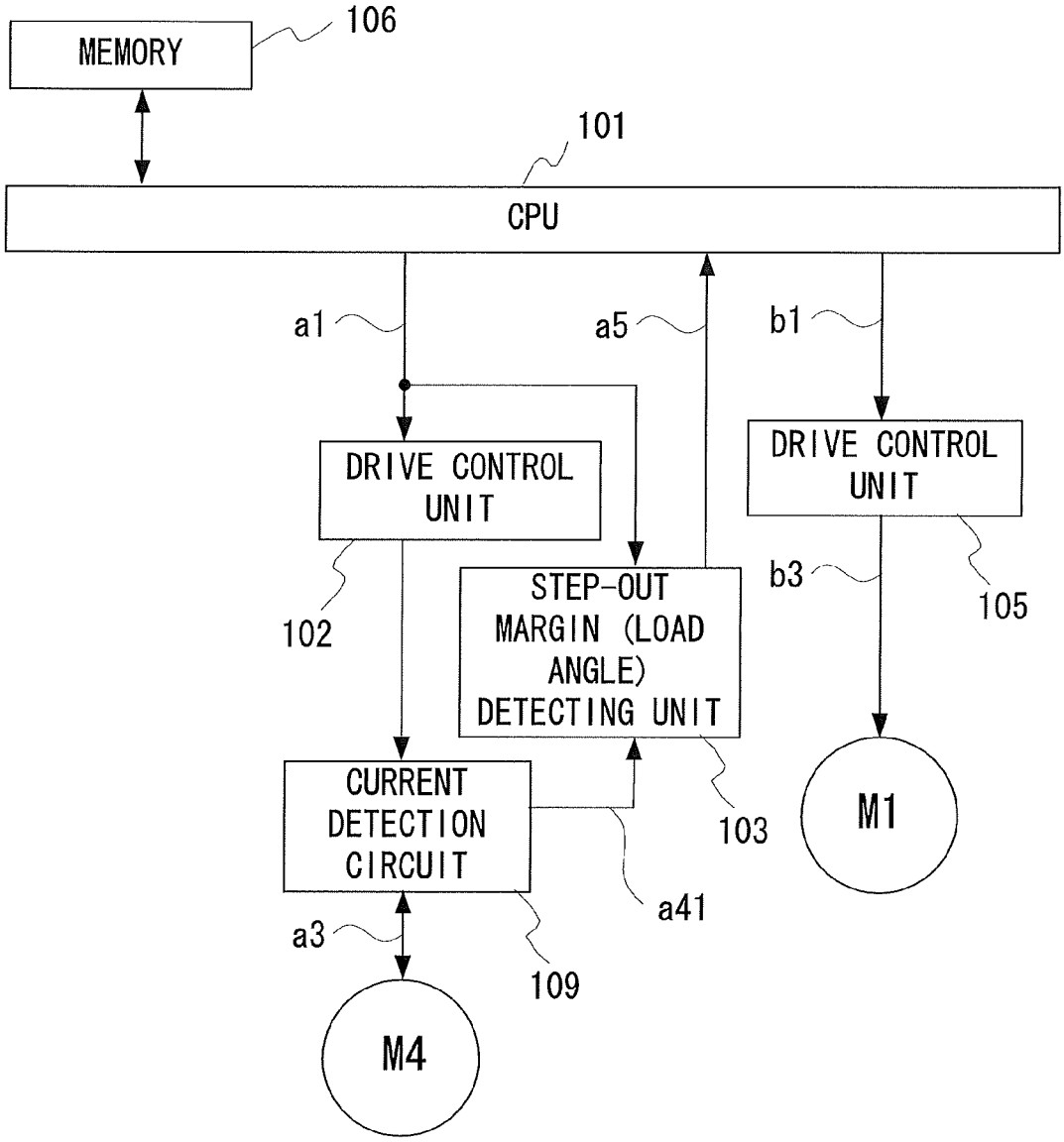
FIG. 9 is an explanatory diagram of a control system for a sheet feeding system and a conveying system.

Next, an example of a case where the load angle is detected by a structure different from the one illustrated in FIG. 2 is described. FIG. 9 is a diagram illustrating a drive control system for the sheet feeding system and the conveying system in this case. As compared to FIG. 2, the encoder 104 is not present, and a current detection circuit 109 is present between the drive control unit 102 and the conveying stepping motor M4 instead. Further, the current set values a2 and b2 are not supplied to the drive control units 102 and 105 from the CPU 101. The other components are the same as those illustrated in FIG. 2, and hence the same reference symbols are used for the components in FIG. 2 that have the equivalent functions.

In the example of FIG. 9, the current detection circuit 109 is interposed in the path for supplying the drive current a3 to the conveying stepping motor M4 from the drive control unit 102. Then, a current waveform a41 flowing in the conveying stepping motor M4 is transferred to the step-out margin (load angle) detection unit 103 from the current detection circuit 109. The step-out margin (load angle) detecting unit 103 detects the load angle of the conveying stepping motor M4 at the time of feeding a sheet from the delay time of the zero-cross point of the current waveform a41.

Second Modification

A sheet sensor (not shown) for detecting improper sheet feeding may be provided in the vicinity of the sheet feed rollers 81. Suppose that while sheet feeding and conveyance are executed by supplying the drive currents at the current set values set in the above-mentioned manner to the stepping motors M1 to M6, the sheet sensor has not detected passing of a sheet for a given time or longer. This is a state where improper sheet feeding occurs in the sheet-feeding stepping motor M1 or M3, such as a state where sheets to be fed contain a sheet thicker than the expected sheet. Through detection thereof, it is possible to determine that a process of coping with improper sheet feeding, specifically, a process of changing the current set value needs to be performed. A similar structure can be adopted for the sheet feed rollers 83.

Further, with use of a cassette open/close detection sensor (not shown), it is also possible to determine that a process of changing the current set value needs to be performed.

Third Modification

In the image forming apparatus 1 illustrated in FIG. 1, only the sheet feeding system and the conveying system can be operated independently. That is, the control system may be separated from the part having the image forming function, such as the photosensitive members 1*a* to 1*d*, to thereby be used as an independent device, e.g., a sheet feeding device.

The present invention is also applicable to an apparatus that controls the movement of a sheet material other than paper, e.g., a thin film resin, when moving the sheet material with a plurality of motors serving as drive sources.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-12310, filed Jan. 24, 2012, which is hereby incorporated by reference herein in its entirety.

What is claimed is:

1. An image forming apparatus for forming an image on a sheet material comprising:

a conveying unit having a plurality of conveying paths to convey the sheet material;

a plurality of first motors configured to drive a plurality of first rollers, each of which is disposed on a respective conveying path of the plurality of conveying paths;

a second motor configured to drive a second roller disposed downstream of a merging point of the plurality of conveying paths;

a detection unit configured to detect a load angle of the second motor;

a third motor configured to drive a third roller disposed downstream of the second roller; and a setting unit configured to set, in accordance with the load angle of the second motor detected by the detection unit at a time of conveying an n-th sheet material, where n is a natural number equal to or larger than 1, current values for the plurality of first motors and the second motor at a time of conveying sheet material following the n-th sheet material, wherein, in accordance with the load angle of the second motor detected by the detection unit at the time of conveying the n-th sheet material, the setting unit sets a current value for the third motor at the time of conveying the n-th sheet material.

2. An image forming apparatus according to claim 1, wherein at the time of conveying the n-th sheet material, the plurality of first motors and the second motor are driven at a predetermined current value.

3. An image forming apparatus according to claim 1, wherein the detection unit detects the load angle in response to a change in a kind of the sheet material to be fed, or in response to power on of the image forming apparatus.

4. An image forming apparatus according to claim 3, further comprising a plurality of cassettes for retaining the sheet material, the plurality of cassettes being mounted detachably, wherein each of the plurality of first motors is a stepping motor disposed as a drive source for a rotor disposed in a path that each of the plurality of first motors is mounted and located upstream of the merging point of the plurality of conveying paths, and wherein the second motor is a stepping motor disposed as a drive source for a rotor disposed in a path located downstream of the merging point of the plurality of conveying paths.

5. An image forming apparatus according to claim 4, wherein a predetermined set torque is a torque needed to convey a sheet material of a type that requires a greatest torque in one of the paths located upstream of the merging point and the path located downstream of the merging point.

6. An image forming apparatus according to claim 5, wherein the setting unit sets the current values in accordance with the type of the sheet material specified by a result of comparison of a generated torque specified by the detected load angle and the set torque.

7. An image forming apparatus according to claim 6, further comprising an encoder configured to detect a rotor position of the second motor, wherein the detection unit detects the load angle by comparing the rotor position detected by the encoder with a target position of the rotor for generating the set torque.

8. An image forming apparatus according to claim 6, further comprising a current detection circuit configured to detect a current waveform at a time of driving the second motor, wherein the detection unit detects the load angle of the second motor from the current values.

* * * * *